US011041381B2

(12) United States Patent
Saad

(10) Patent No.: US 11,041,381 B2
(45) Date of Patent: Jun. 22, 2021

(54) SYSTEMS AND METHODS FOR MEASURING RATE OF PENETRATION

(71) Applicant: Schlumberger Technology Corporation, Sugar Land, TX (US)

(72) Inventor: Mohamed Abdeliamin Saad, Stonehouse (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/895,290

(22) Filed: Jun. 8, 2020

(65) Prior Publication Data

US 2020/0300081 A1 Sep. 24, 2020

Related U.S. Application Data

(62) Division of application No. 15/828,555, filed on Dec. 1, 2017, now Pat. No. 10,677,045.

(51) Int. Cl.

| | |
|---|---|
| ***E21B 47/09*** | (2012.01) |
| ***E21B 44/00*** | (2006.01) |
| ***E21B 45/00*** | (2006.01) |

(52) U.S. Cl.

CPC ..... *E21B 47/09* (2013.01); *E21B 44/00* (2013.01); *E21B 45/00* (2013.01)

(58) Field of Classification Search

None

See application file for complete search history.

(56) References Cited

U.S. PATENT DOCUMENTS

| | | | |
|---|---|---|---|
| 9,706,185 | B2 | 7/2017 | Ellis |
| 9,912,918 | B2 | 3/2018 | Samuel |
| 10,012,041 | B2 | 7/2018 | Lane |
| 10,068,305 | B2 | 9/2018 | Sisk et al. |
| 10,227,859 | B2 | 3/2019 | Richards et al. |
| 10,281,270 | B2 | 5/2019 | Smith et al. |
| 10,443,325 | B2 | 10/2019 | Zheng et al. |
| 2019/0128114 | A1* | 5/2019 | Bryant ..... E21B 19/16 |
| 2019/0136650 | A1* | 5/2019 | Zheng ..... E21B 19/165 |
| 2019/0234202 | A1 | 8/2019 | Orban et al. |
| 2020/0224523 | A1 | 7/2020 | Parmeshwar et al. |
| 2020/0224524 | A1 | 7/2020 | Parmeshwar et al. |
| 2020/0224525 | A1 | 7/2020 | Parmeshwar et al. |
| 2020/0224526 | A1 | 7/2020 | Parmeshwar et al. |

FOREIGN PATENT DOCUMENTS

WO 2020172144 A1 8/2020

* cited by examiner

*Primary Examiner* — Jamel E Williams

(57) ABSTRACT

Systems and methods for measuring rate of penetration (ROP) and well depth of a drill string are disclosed. As the drill string is constructed, a pair of rangefinders are positioned near the well site and are configured to measure a distance to points on the drill string without human intervention. The rangefinders calculate a length of drill string segments the measured distances and from the length and an elapsed time calculate an accurate, automatically generated ROP.

12 Claims, 6 Drawing Sheets

SYSTEMS AND METHODS FOR MEASURING RATE OF PENETRATION

This application is a divisional application of U.S. application Ser. No. 15/828,555 with the same title filed on Dec. 1, 2017 which is incorporated by reference herein in its entirety.

BACKGROUND

Drilling in the oil and gas industry is a complicated and difficult endeavor. Many of the challenges stem from the fact that access to data within a wellbore is difficult to obtain. Some wells are thousands of feet deep. One measurement of particular importance to drilling operations is called the Rate of Penetration ("ROP") and it refers to how fast a drill string is entering the well. There have been many attempts to calculate ROP. Some of the existing methods are time and labor intensive and potentially less accurate than ideal. The present disclosure is directed at calculating ROP in an efficient manner.

SUMMARY

Embodiments of the present disclosure are directed to systems for calculating rate of penetration (ROP). The systems include a drill string having a plurality of pipe segments coupled together end-to-end with the drill string being configured to advance into a wellbore during a drill operation. The systems also includes a first rangefinder and a second rangefinder configured to observe the pipe segments as the pipe segments advance into the wellbore. The first rangefinder is spaced apart from the second rangefinder in a direction generally aligned with the drill string. The first and second rangefinders locate at least one identifier on one or more pipe segments. The systems also include a calculation component configured to calculate a distance between two identifiers on the drill string and to calculate the ROP as a ratio of summed multiple measurements between identifiers and elapsed time.

Other embodiments of the present disclosure are directed to systems for measuring a rate of penetration (ROP) of a drill string in a wellbore including a first rangefinder positioned at a wellsite and being configured to observe the drill string as the drill string is being constructed and lowered into the wellbore, the drill string comprising a plurality of pipe segments, and a second rangefinder positioned at the wellsite and being configured to observe the drill string as the drill string is being constructed and lowered into the wellbore. The second rangefinder is spaced apart from the first rangefinder. The first and second rangefinders are configured to observe a first identifier and a second identifier on one or more of the pipe segments and to measure a distance between each rangefinder and each identifier. A distance between the first and second rangefinders is known. The systems also include a computation component configured to calculate a distance between the first and second identifiers using the distances between each rangefinder and each identifier and the distance between the first and second rangefinders, and to calculate the ROP by repeatedly calculating distances between consecutive identifiers and summing the lengths. The ROP for a given time period is equal to the ratio of the summed lengths and the given time period in terms of distance per unit time.

Still further embodiments of the present disclosure are directed to methods for calculating rate of penetration (ROP) for a drill string. The methods include positioning two rangefinders relative to the drill string, the drill string comprising a plurality of segments, wherein the rangefinders observe the segments as the segments enter a wellbore. The rangefinders are separated by a distance along the drill string. The methods also include periodically measuring a distance between points on the drill string and each of the rangefinders, calculating a length of the segments from the distance between two points on the drill string from the distance from the two rangefinders and the two points, and adding the length to a running total length. The methods can also include calculating a ratio of the running total length and an elapsed time corresponding to the running total length.

DETAILED DESCRIPTION

Figure 1:
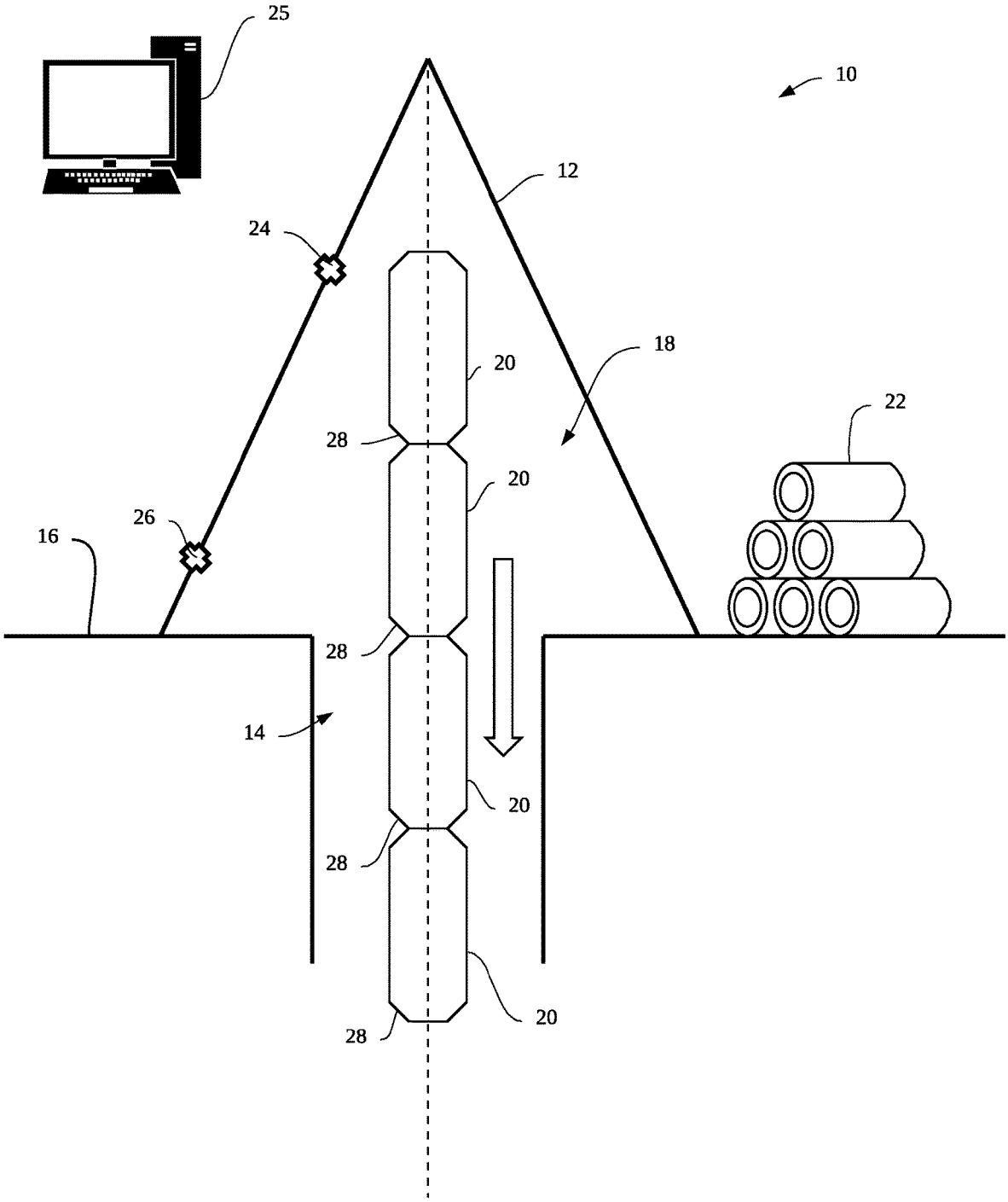
FIG. 1 is a schematic side cross-sectional view of a drill rig 10 according to embodiments of the present disclosure.

Below is a detailed description according to various embodiments of the present disclosure. FIG. 1 is a schematic side cross-sectional view of a drill rig 10 according to embodiments of the present disclosure. The components shown in FIG. 1 are typical to a drilling operation; however, aspects of the present disclosure are not necessarily limited to the environment shown here and may have application in other industries. In some embodiments, the drill rig 10 includes a derrick 12 which supports drilling equipment used to drill a wellbore 14. The derrick 12 rests on the earth's surface 16 (or other appropriate surface such as a seabed or offshore rig) and is positioned over the wellbore 14. As the drilling operation is carried out, a drill string 18 (a.k.a. string) is constructed and lowered into the wellbore 14. The drill string 18 is constructed of pipe segments 20 which are connected end-to-end connecting the drill bit all the way up to the surface. Any number of pipe segments can be used to create a drill string of virtually any length. The next pipe segments 22 are shown and will be added to the top of the string 18 once the string is ready to move downward sufficiently. The drill string 18 can include segments that are not technically pipes, such as tools, subs, packers, and any number of other segments. For purposes of brevity and conciseness, the segments of the drill string 18 are referred to herein as pipe segments.

The rate of penetration ("ROP") is calculated as the speed at which the string is constructed and can be expressed in terms of distance per unit time. In many such drilling operations, the length of the pipe segments 20 is known and a rough calculation of the ROP can be obtained simply by adding the length of the segments and dividing by the elapsed time. There are problems with this approach. For one, counting the pipe segments 20 has traditionally been carried out manually by visual inspection which requires a skilled operator to watch carefully and to correctly record each pipe segment. This is a task which becomes more difficult the higher the ROP becomes and is inherently error-prone. The systems and methods of the present disclosure provide an improved approach that eliminates the human error aspect and accounts for variability in pipe segment length and in the connections between the pipe segments.

According to embodiments of the present disclosure, the drill rig 10 includes rangefinders 24 and 26, shown schematically attached to the derrick 12 at different heights and a calculation component 25. There can be any number of rangefinders, including a single rangefinder adapted to perform as described herein. The rangefinders 24, 26 are at different vertical locations. At various times during the drilling operation the rangefinders 24, 26 identify a beginning and ending of each pipe segment 20 and calculate a distance between the beginning and ending of each pipe segment 20. The pipe segments 20 are shown having a chamfered surface 28 at each top and bottom. The rangefinders 24, 26 are configured to identify the top and bottom of the pipe segments using such a feature or another identifiable feature on the pipe segments 20. The length of each pipe segment 20 is added to a running total length number. The ROP is calculated as this length number over a predetermined time period. The rangefinders 24, 26 are configured to communicate with the calculation component 25 and to operate automatically to eliminate the chance for human error to affect the calculation of ROP.

Figure 2:
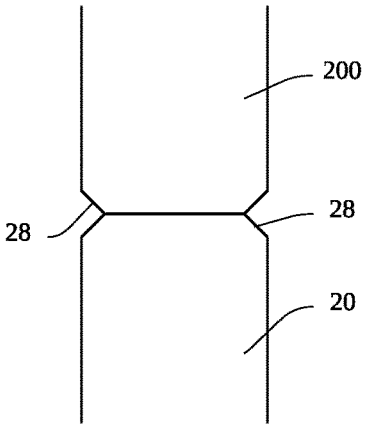
FIG. 2 is a schematic illustration of a connection between two pipe segments 20 according to embodiments of the present disclosure.
Figure 3:
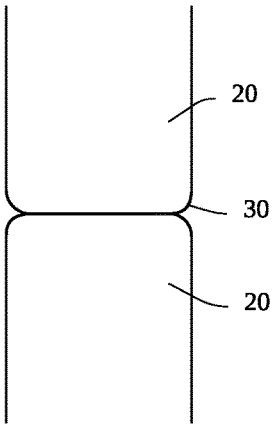
FIG. 3 is a schematic illustration of a connection between two pipe segments 20 having a rounded profile 30 at the connection according to embodiments of the present disclosure.
Figure 4:
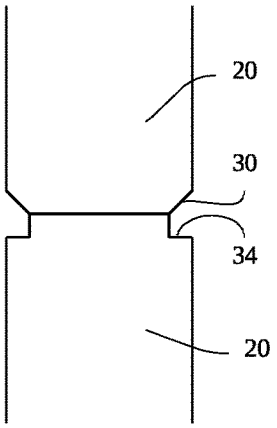
FIG. 4 is a schematic illustration of a connection between pipe segments 20 in which one segment has a chamfered profile 32 and another pipe section has a notched profile 34.

FIG. 2 is a schematic illustration of a connection between two pipe segments 20 according to embodiments of the present disclosure. The rangefinders described above can be equipped with a technology known as edge detection. Edge detection is an image processing technique for finding the boundaries of objects within images. It works by detecting discontinuities in brightness. Edge detection is used for image segmentation and data extraction in areas such as image processing, computer vision, and machine vision. Common edge detection algorithms include Sobel, Canny, Prewitt, Roberts, and fuzzy logic methods. The pipe segments 20 have a chamfered surface 28 which is easily identifiable by a rangefinder. FIG. 3 is a schematic illustration of a connection between two pipe segments 20 having a rounded profile 30 at the connection according to embodiments of the present disclosure. FIG. 4 is a schematic illustration of a connection between pipe segments 20 in which one segment has a chamfered profile 32 and another pipe section has a notched profile 34. Virtually any profile can be used, and the rangefinders can be calibrated to detect the beginning and ending of the pipe segments using the available information.

The rangefinders can be optical using light to detect the ends of the pipe segments, or acoustic (sonar) using sound waves reflected off the pipe segments. In some embodiments the rangefinders use LIDAR, which stands for Light Detection and Ranging, which is a remote sensing method that uses light in the form of a pulsed laser to measure ranges (variable distances). Some rangefinders can use radar technology. RFID technology can be used as well.

Figure 5:
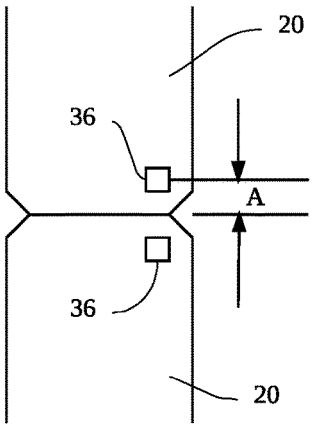
FIG. 5 is a schematic illustration of a connection between two pipe segment 20 which are equipped with RFID tags 36 according to embodiments of the present disclosure.

FIG. 5 is a schematic illustration of a connection between two pipe segments 20 which are equipped with RFID tags 36 according to embodiments of the present disclosure. The RFID tags 36 can be placed at the end of the pipe segments or near to the end and the rangefinders can be configured to identify the position of the RFID tags 36 and thereby calculate the ROP for the drilling operation. The RFID tags 36 can be placed a certain known distance A from the end of the pipe segment and this distance can be added into the running total length number to calculate the ROP. There can be an RFID tag 36 at each end of the pipe segment. Each tag can have a distance to its corresponding end. For example, the first tag has a distance to a first end (the top) and the second tag has a distance to the second end (the bottom) of the pipe segment. In other embodiments there can be a single RFID tag having two distances: one to the top and one to the bottom. This information can be stored in the RFID tag itself and the rangefinder is configured to read the data and incorporate it into the ROP calculation.

Figure 6:
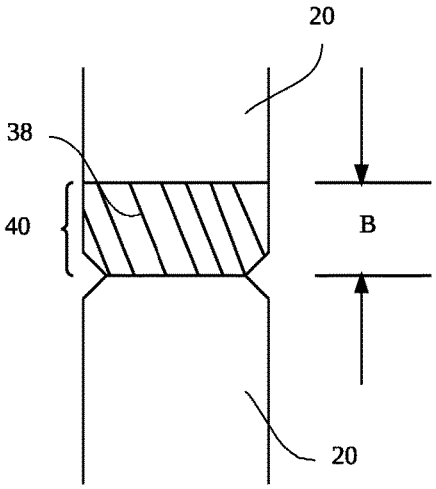
FIG. 6 is another illustration of a connection between pipe segments 20 according to embodiments of the present disclosure.

FIG. 6 is another illustration of a connection between pipe segments 20 according to embodiments of the present disclosure. The pipe segments 20 have been treated with a reflective or otherwise identifiable characteristic at an end 38 of the pipe segment. The treatment could be a knurling, a reflective coating, a paint, or another remotely identifiable characteristic which is observable by the rangefinders. In some embodiments, this treatment is applied to a region having a length B extending from the end of the pipe segment 20 the distance B into the length of the pipe segment. The rangefinders can be configured to identify the end of the pipe segment using some varied methods. In some embodiments, the rangefinders make many point calculations over the treated area 40, and from the point calculations can derive where the end of the pipe segment is. In other embodiments, as the pipe segment moves through the observed area of the rangefinder, the treated area 40 is identified as entering or leaving the observed area. Depending on whether the observed end of the pipe segment is a top or a bottom of the given pipe segment, when the treated area 40 leaves the observed region for the rangefinders, a notation can be made indicating the beginning or ending of the pipe segment.

Figure 7:
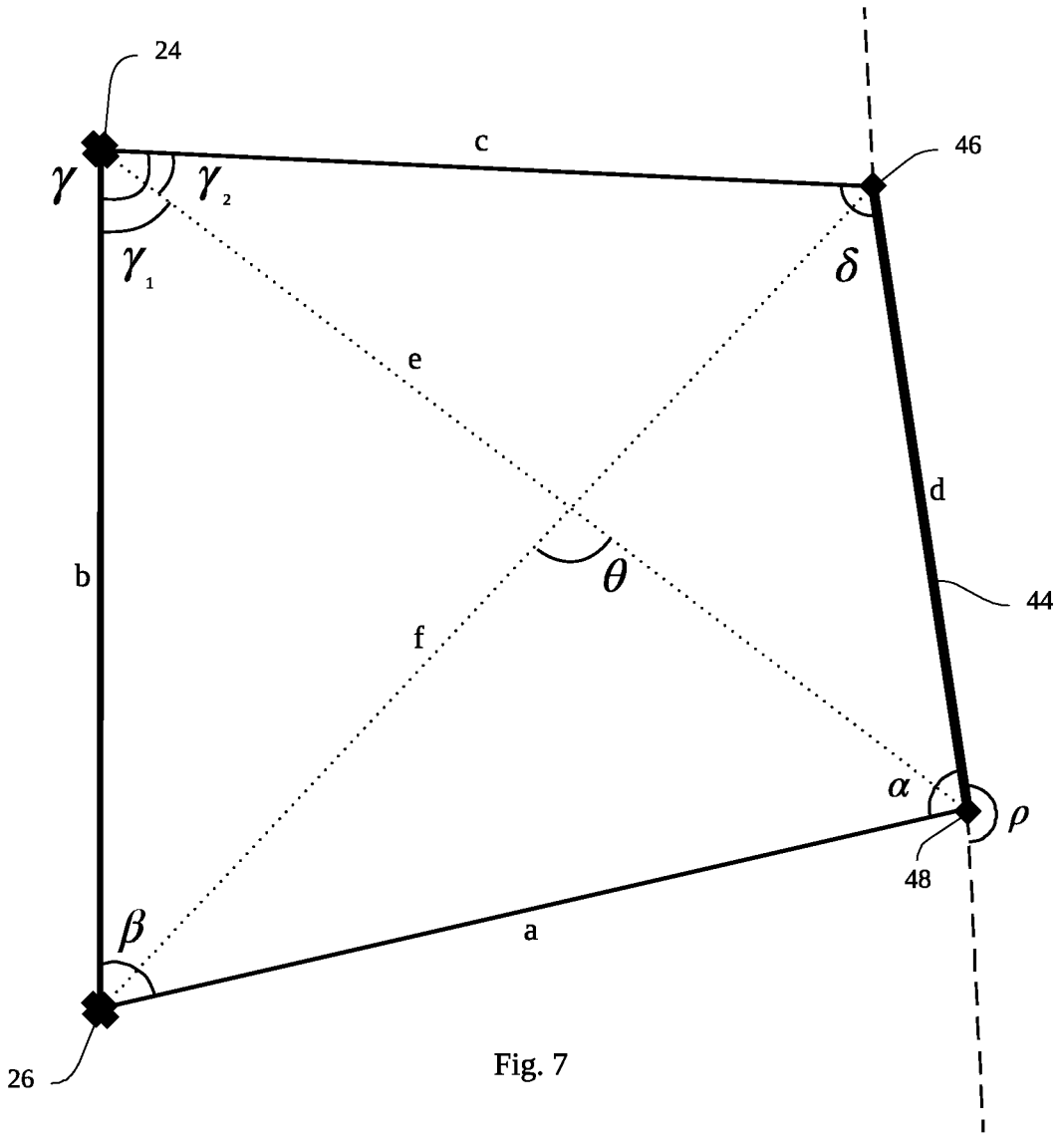
FIG. 7 is a diagram of the relationship between rangefinder(s) and a pipe segment according to embodiments of the present disclosure.

FIG. 7 is a diagram of the relationship between rangefinder(s) and a pipe segment according to embodiments of the present disclosure. Two rangefinders 24 and 26 (or a single rangefinder with similar capabilities) are positioned relative to a pipe segment 44 similar to the configuration shown in FIG. 1. The pipe segment 44 has a first end 46 and a second end 48. The first end 46 can be the top and the second end 48 can be the bottom, and the first rangefinder 24 can be the top rangefinder and the second rangefinder 26 can be the bottom rangefinder. The terms top and bottom are used for convenience and not in a limiting manner. The rangefinders 24, 26, are used to measure the distance d between the first end 46 and the second end 48. The distance c is between the first rangefinder 24 and the first end 46. The distance b is between the two rangefinders 24, 26. The distance a is between the second rangefinder 26 and the second end 48. The distance f is between the second rangefinder 26 and the first end 46. The distance e is between the first rangefinder 24 and the second end 48. The angle $\alpha$ is between a and d. The angle $\delta$ is between c and d. The angle $\beta$ is between a and b. The angle $\theta$ is between e and f. The angle $\gamma$ is between b and c. The angle $\gamma_1$ is between b and e. The angle $\gamma_2$ is between e and c. The rangefinders 24, 26, can measure the distances a, b, c, e, and f. The distance b between rangefinders can be calculated or it is a known, fixed parameter because the rangefinders are in a fixed position on the derrick. Therefore, the distances a, b, c, e, and f are known, leaving only the distance d, the pipe segment length, unknown. The rangefinders 24, 26 are shown in FIG. 7 in a vertical relationship and the pipe segment 44 is not necessarily parallel. The systems and methods disclosed herein are capable of measuring d even if the pipe segment 44 is out of alignment with the rangefinders as is shown with the angle $\rho$ being between pipe segment d and the next pipe segment (shown in phantom). The diagram shows an irregular quadrilateral. Using the following equations starting with the cosine rule, the distance d can be obtained:

$$f^2 = c^2 + b^2\ 2bc\cos\gamma$$

$$\gamma = \cos^{-1}\frac{f^2\ c^2\ b^2}{2bc}$$

$$e^2 = a^2 + b^2\ 2ab\ \cos\beta$$

$$\beta = \cos^{-1}\frac{e^2\ a^2\ b^2}{2ab}$$

$$a^2 = e^2 + b^2\ 2be\cos\gamma_1$$

$$\gamma_1 = \cos^{-1}\frac{a^2\ e^2\ b^2}{2be}$$

From these equations $\gamma$, $\gamma_1$, and $\beta$ are known. We can find $\gamma_2$ using:

$$\gamma_2=\gamma\gamma_1$$

Using the cosine rule, we can now solve for d:

$$d^2=c^2+e^2\ 2ce\ \cos\gamma_2$$

$$d=\sqrt{c^2+e^2 2ce\cos\gamma_2}$$

Where d is the length of the pipe segment 44. Using these techniques and equations, the length of each pipe segment in a drill string can be measured which leads to an accurate measurement of ROP without the need for manual inspection and at any speed.

Figure 8:
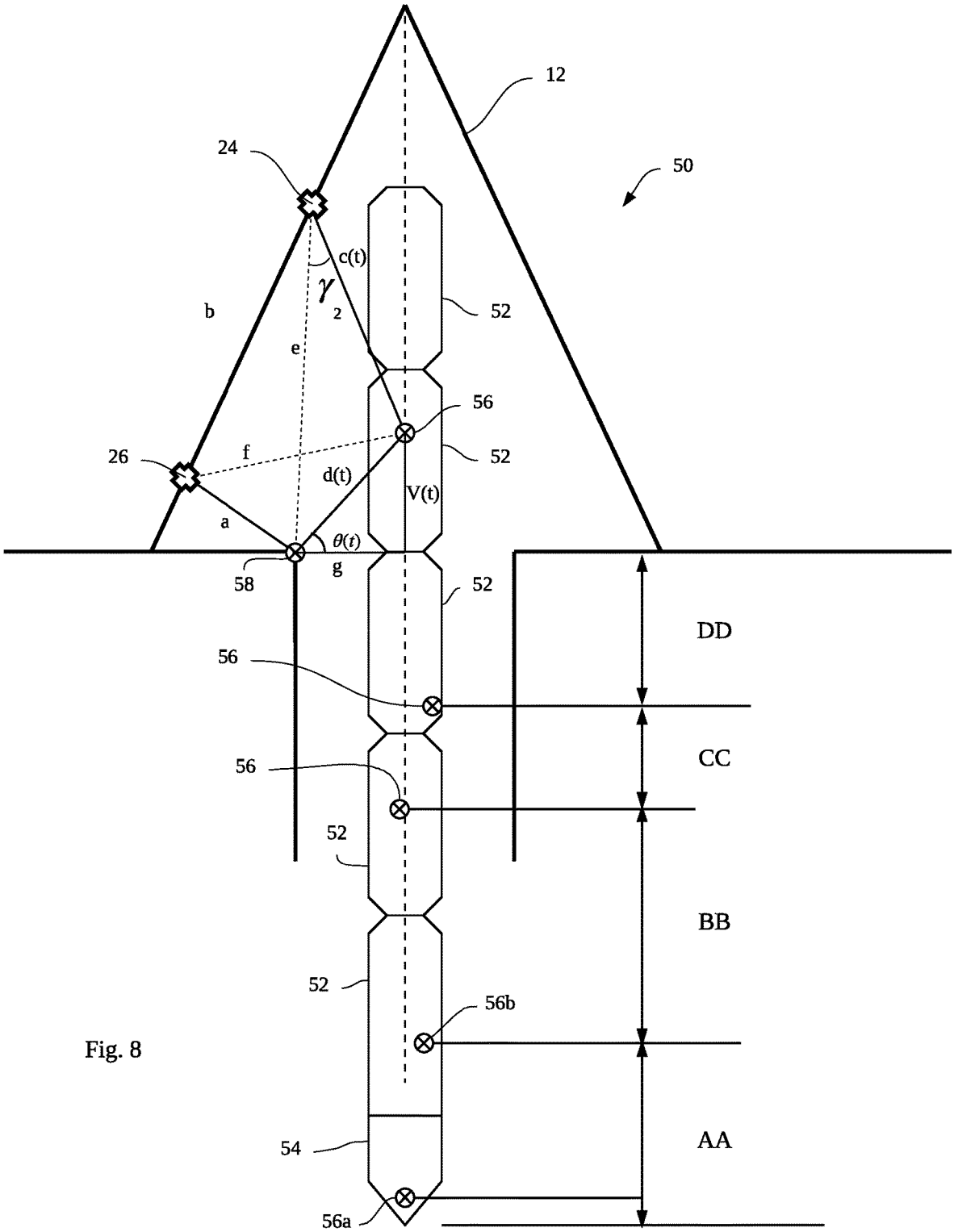
FIG. 8 is a schematic illustration of a drill string 50 according to embodiments of the present disclosure.

FIG. 8 is a schematic illustration of a drill string 50 according to embodiments of the present disclosure. The drill string 50 is made up of pipe segments 52 and is supported by a derrick 12 and is analyzed by rangefinders 24, 26 similar to the configuration of FIG. 1. The drill string 50 also includes a drill bit 54 at a distal end of the string 50. Each pipe segment 52 has an identifier 56 which can be an RFID tag, a reflective decal, an engraved marking, a paint, or any other suitable marking which is measurable by the rangefinders. The system can include an identifier 58 at a stationary location on the rig or near the formation. The identifier 58 can be selectively movable or fixed and provides a reference point from which to measure several distances as disclosed herein. A diagram similar to what is shown in FIG. 7 is included as a schematic overlay in FIG. 8. The diagram is a trapezoid between rangefinders 24 and 26, any arbitrary identifier 56 on one or more of the pipe segments 52, and the reference identifier 58. The trapezoid includes at least four legs a, b, c(t), and d(t). Leg a is between the reference identifier 58 and the second rangefinder 26, leg b is between the first and second rangefinders 24, 26, leg c(t) is between the first rangefinder 24 and an arbitrary identifier 56 on a pipe segment 52, and leg d(t) is between the arbitrary identifier 56 and the reference identifier 58. Two other legs can be used to make the calculations: V(t) is the vertical distance between the arbitrary identifier 56 and the reference identifier 58, and g is the horizontal distance between the arbitrary identifier 56 and the reference identifier 58. Theta $\theta(t)$ is the angle between d(t) and g. Between the first rangefinder 24 and the reference identifier 58 is e, between the second rangefinder 26 and the arbitrary identifier 56 is f, and the angle between e and c(t) is $\gamma_2$. Some of the legs are described herein as varying as a function of time using "c(t)" or "V(t)" for example. In some embodiments, these legs and the distances they represent can change over time. It is to be understood that other legs that are not necessarily shown with the notation (t) can also change over time as circumstance require without departing from the scope of the present disclosure. The identifiers 56 can be at any arbitrary location on the pipe segments 52. There can be more than one identifier 56 per pipe segment 52. The identifiers 56 can be manufactured as part of the pipe segments, or can be applied at the rig site.

Legs c(t), d(t), V(t), and will vary as a function of time and thus are shown in FIG. 8 as c(t), d(t), V(t), and $\theta(t)$. The rangefinders 24, 26 are configured to observe and measure the location of the identifiers 56 and perform the calculations described elsewhere in the present disclosure to calculate ROP. The rangefinders can calculate the ROP by measuring the distance between each pair of identifiers 56. In some embodiments the following equations can be used to calculate d and V as a function of time:

$$d(t)=c(t)^2+e^2 2c(t)e\ \cos\gamma_2$$

$$V(t)=g^2+d(t)^2 2gd(t)\cos\theta(t)$$

Combining these two equations yields:

$$V(t)=g^2+[c(t)^2+e^2 2c(t)e\ \cos\gamma_2]^2 2g[c(t)^2+e^2 2c(t)e\ \cos\gamma_2]\cos\theta(t)$$

This equation gives V(t) which is defined as the rate at which any arbitrary identifier 56 passes into the well. V(t) can be calculated continuously to yield a real-time ROP.

The drill bit 54 can represent the extreme end of the string 50. The first segment AA is measured between the drill bit 54 and the next pipe segment's identifier 56*a*, the second segment BB between the identifier 56*a* and the next identifier 56*b*. Segments CC and DD are calculated the same way. The position of the identifier 56 relative to the pipe segment 52 does not affect the calculation provided the angle between any two pipe segments is small. There can be virtually any number of identifiers 56 on the drill string. There can be pipe segments that do not have an identifier. Provided that no two identifiers are farther apart than the rangefinders' range, the identifiers can be in any position.

Figure 9:
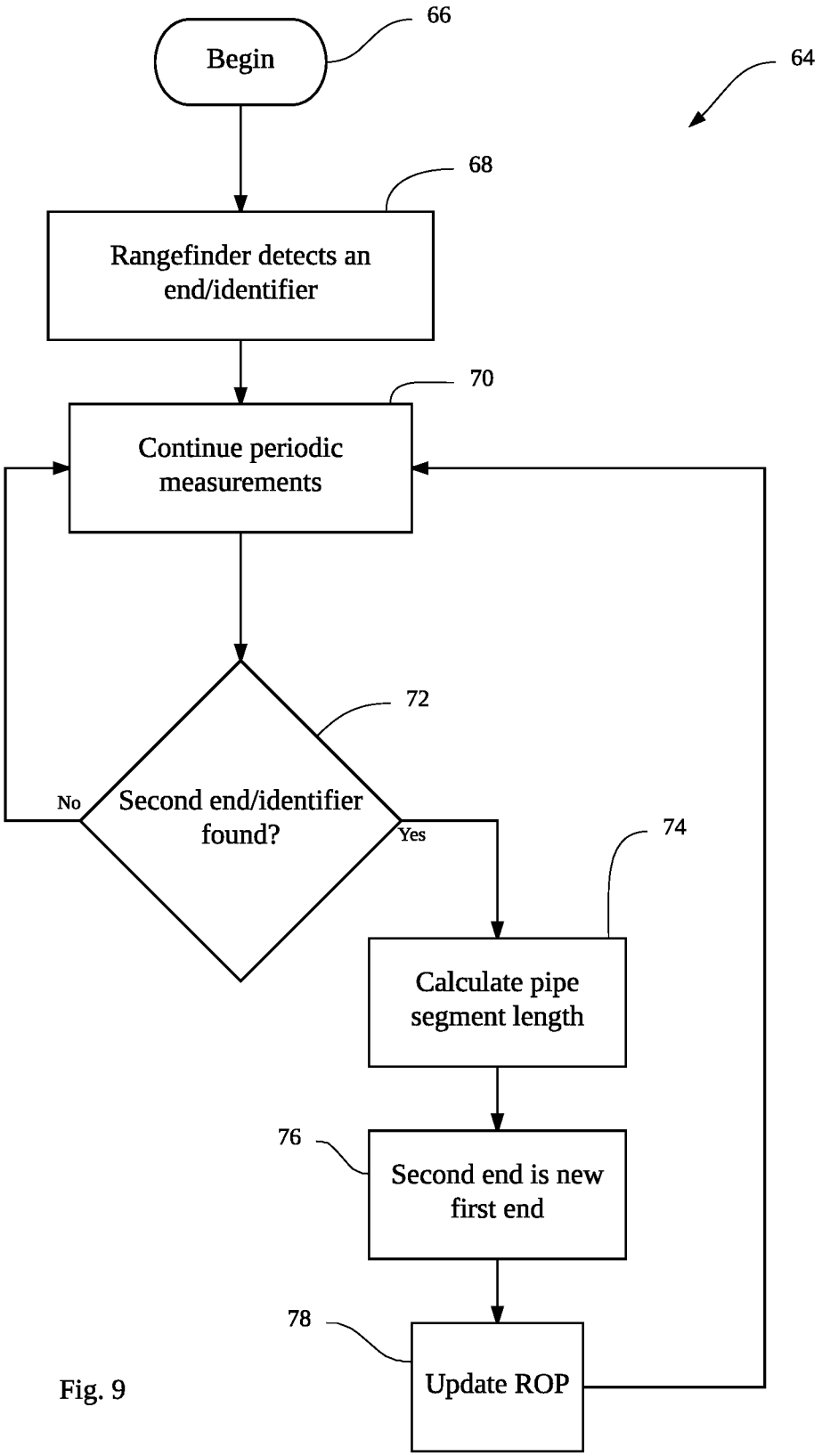
FIG. 9 is a block diagram of a method 64 of calculating ROP according to embodiments of the present disclosure.

FIG. 9 is a block diagram of a method 64 of calculating ROP according to embodiments of the present disclosure. The method 64 begins 66. The initial measurement of ROP can be to identify a first point on the drill string from which the second measurement will be taken. The initial measurement can be taken from a drill bit or another component representing an extreme, deepest point on the drill string, or it can be any arbitrary point along the drill string from which the measurements will be taken. At 68 the rangefinder detects an end of a pipe segment or an identifier or whatever suitable observable component is being measured. After locating the first end/identifier, at 70 the rangefinders continue taking periodic measurements. The frequency of the measurements can vary according to the expected ROP. The slower the ROP, the more infrequent the measurements can be. The method 64 continues by checking for a second end/identifier at 72. Once the second end/identifier enters the observed range of the rangefinders, the method 64 includes calculating a length of the pipe segment. The calculations can be carried out as described above. At 74 the second end is designated as the new first end and the method 64 continues at 70 by taking periodic measurements. At 76 the ROP is updated by adding the current pipe segment length to a running total for a given portion of the drill string and dividing by the elapsed time. The method 64 can also include a check of whether the frequency of periodic measurements taking at 70 is too fast or too slow and if so, updating the frequency of periodic measurements.

Figure 10:
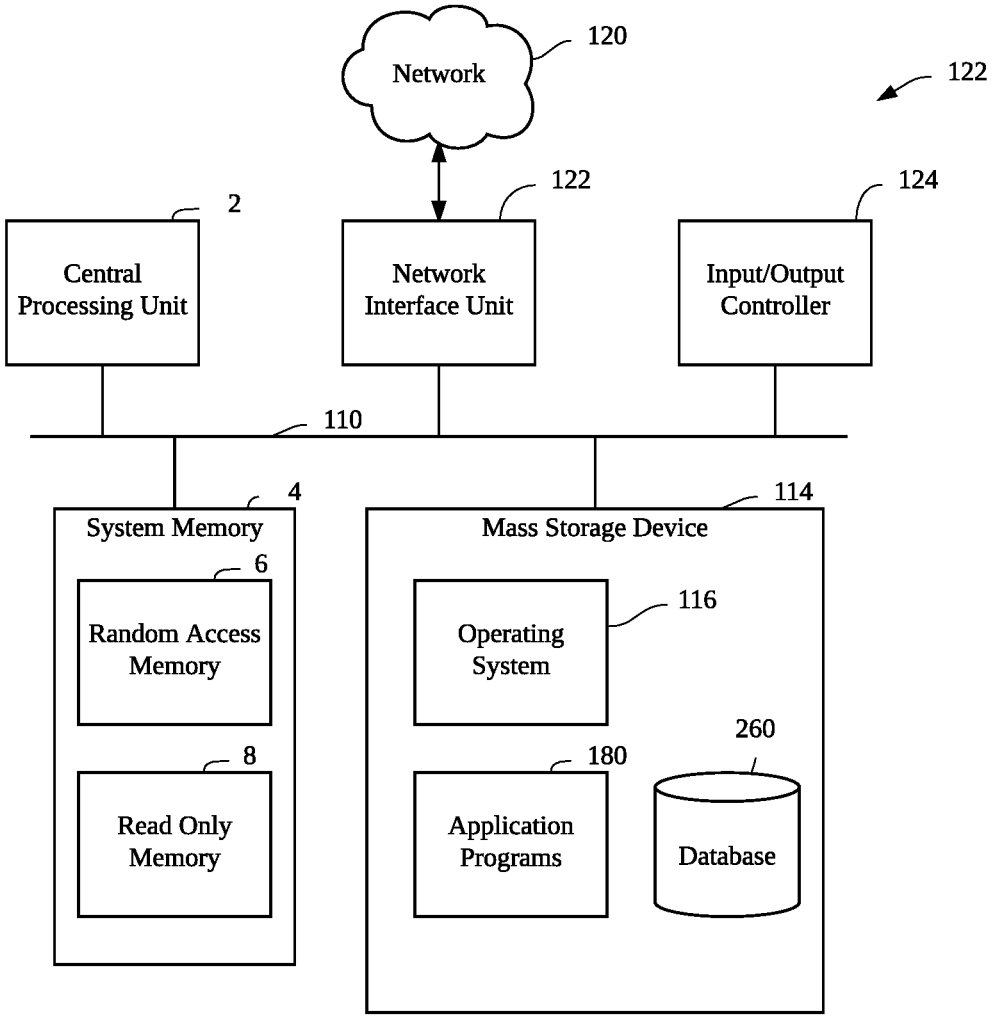
FIG. 10 is a FIG. 1 is a block diagram of an operating environment for implementations of computer-implemented methods according to embodiments of the present disclosure.

FIG. 10 is a block diagram of an operating environment for implementations of computer-implemented methods according to embodiments of the present disclosure. FIG. 10 and the corresponding discussion are intended to provide a brief, general description of a suitable computing environment in which embodiments may be implemented.

Generally, program modules include routines, programs, components, data structures, and other types of structures that perform particular tasks or implement particular abstract data types. Other computer system configurations may also be used, including hand-held devices, multiprocessor systems, microprocessor-based or programmable consumer electronics, minicomputers, mainframe computers, and the like. Distributed computing environments may also be used where tasks are performed by remote processing devices that are linked through a communications network. In a distributed computing environment, program modules may be located in both local and remote memory storage devices.

Referring now to FIG. 10, an illustrative computer architecture for a computer 122 utilized in the various embodiments will be described. The computer architecture shown in FIG. 10 may be configured as a desktop or mobile computer and includes a central processing unit 2 ("CPU"), a system memory 4, including a random access memory 6 ("RAM") and a read-only memory ("ROM") 8, and a system bus 110 that couples the memory to the CPU 2.

A basic input/output system containing the basic routines that help to transfer information between elements within the computer, such as during startup, is stored in the ROM 8. The computer 122 further includes a mass storage device 114 for storing an operating system 116, application programs 180, and other program modules, which will be described in greater detail below.

The mass storage device 114 is connected to the CPU 2 through a mass storage controller (not shown) connected to the bus 110. The mass storage device 114 and its associated computer-readable media provide non-volatile storage for the computer 122. Although the description of computer-readable media contained herein refers to a mass storage device, such as a hard disk or CD-ROM drive, the computer-readable media can be any available media that can be accessed by the computer 122. The mass storage device 114 can also contain one or more databases 260.

By way of example, and not limitation, computer-readable media may comprise computer storage media and communication media. Computer storage media includes volatile and non-volatile, removable and non-removable media implemented in any method or technology for storage of information such as computer-readable instructions, data structures, program modules or other data. Computer storage media includes, but is not limited to, RAM, ROM, EPROM, EEPROM, flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer 122.

According to various embodiments, computer 122 may operate in a networked environment using logical connections to remote computers through a network 120, such as the Internet. The computer 122 may connect to the network 120 through a network interface unit 122 connected to the bus 110. The network connection may be wireless and/or wired. The network interface unit 122 may also be utilized to connect to other types of networks and remote computer systems. The computer 122 may also include an input/output controller 124 for receiving and processing input from a number of other devices, including a keyboard, mouse, or electronic stylus (not shown in FIG. 10). Similarly, an input/output controller 124 may provide output to a display screen, a printer, or other type of output device (not shown).

As mentioned briefly above, a number of program modules and data files may be stored in the mass storage device 114 and RAM 6 of the computer 122, including an operating system 116 suitable for controlling the operation of a networked personal computer. The mass storage device 114 and RAM 6 may also store one or more program modules. In particular, the mass storage device 114 and the RAM 6 may store one or more application programs 180.

The foregoing disclosure hereby enables a person of ordinary skill in the art to make and use the disclosed systems without undue experimentation. Certain examples are given to for purposes of explanation and are not given in a limiting manner.

The invention claimed is:

1. A system for calculating rate of penetration (ROP), comprising:

a drill string having a plurality of pipe segments coupled together end-to-end, the drill string being configured to advance into a wellbore during a drill operation;

a first rangefinder and a second rangefinder configured to observe the pipe segments as the pipe segments advance into the wellbore, the first rangefinder being spaced apart from the second rangefinder, wherein the first and second rangefinders are configured to locate at least one identifier on one or more pipe segments; and a calculation component configured to calculate a penetration distance by summing distances between identifiers and to calculate the ROP as the penetration distance achieved during an elapsed time.

2. The system of claim 1 wherein one of the identifiers is attached to the drill string and the other identifier is fixed at a reference point.

3. The system of claim 1 wherein the identifiers comprise an end of the pipe segments, and wherein the ends are located using edge detection.

4. The system of claim 1 wherein the rangefinders are configured to acoustically locate the identifiers.

5. The system of claim 1 wherein the first and second rangefinders have an observable range, and wherein the identifiers are located on pipe segments at intervals less than the observable range.

6. The system of claim 5 wherein each pipe segment has at least one identifier.

7. The system of claim 5, wherein at least one pipe segment includes two or more components wherein at least one of the components does not include an identifier.

8. The system of claim 1 wherein the pipe segments comprise at least one of pipes, tools, subs, packers, or drill equipment.

9. The system of claim 1 wherein the calculation component is configured to report the ROP to a remote operator.

10. A system for measuring a rate of penetration (ROP) of a drill string in a wellbore, the system comprising:

a first rangefinder positioned at a wellsite and being configured to observe the drill string as the drill string is being constructed and lowered into the wellbore, the drill string comprising a plurality of pipe segments;

a second rangefinder positioned at the wellsite and being configured to observe the drill string as the drill string is being constructed and lowered into the wellbore, the second rangefinder being spaced apart from the first rangefinder;

wherein the first and second rangefinders are configured to observe a first identifier and a second identifier on one or more of the pipe segments and to measure a distance between each rangefinder and each identifier, and wherein a distance between the first and second rangefinders is known; and a computation component configured to:

calculate a distance between the first and second identifiers using the distances between each rangefinder and each identifier and the distance between the first and second rangefinders; and calculate the ROP by calculating distances between identifiers and summing the distances, wherein the ROP for a given time period is equal to a ratio of the summed distances and the given time period.

11. The system of claim 10 wherein the rangefinders are LiDAR, acoustic, radar, optical, electromagnetic, or RFID rangefinders and wherein the identifiers correspond to the rangefinders.

12. The system of claim 10 wherein the identifiers on the pipe segments comprise an edge and wherein the rangefinders are configured to use edge detection to observe the edge.

* * * * *